US005701764A

United States Patent [19]

Agrawal et al.

[11] Patent Number: 5,701,764

[45] Date of Patent: Dec. 30, 1997

[54] PROCESS TO PRODUCE MODERATE PURITY OXYGEN USING A DOUBLE COLUMN PLUS AN AUXILIARY LOW PRESSURE COLUMN

[75] Inventors: Rakesh Agrawal, Emmaus; Zbigniew Tadeusz Fidkowski, Macungie; Donn Michael Herron, Fogelsville, all of Pa.

[73] Assignee: Air Products and Chemicals, Inc., Allentown, Pa.

[21] Appl. No.: 692,990

[22] Filed: Aug. 6, 1996

[51] Int. Cl.[6] ..... F25J 3/00

[52] U.S. Cl. ..... 62/646; 62/654; 62/939

[58] Field of Search ..... 62/646, 654, 939

[56] References Cited

U.S. PATENT DOCUMENTS

| | | | |
|---|---|---|---|
| 4,410,343 | 10/1983 | Ziemer | 62/29 |
| 4,702,757 | 10/1987 | Kleinberg | 62/24 |
| 5,231,837 | 8/1993 | Ha | 62/24 |
| 5,265,429 | 11/1993 | Dray | 62/654 |
| 5,337,570 | 8/1994 | Prosser | 62/25 |
| 5,456,083 | 10/1995 | Hogg et al. | 62/646 |
| 5,546,766 | 8/1996 | Higginbotham | 62/654 |
| 5,572,874 | 11/1996 | Rathbone | 62/646 |

FOREIGN PATENT DOCUMENTS 0-615105A1 9/1994 European Pat. Off. .

*Primary Examiner*—Ronald C. Capossel
*Attorney, Agent, or Firm*—Robert J. Wolff

[57] ABSTRACT

A process is set forth for the cryogenic distillation of an air feed to produce an oxygen product, particularly an oxygen product at moderate purity (80–99%, preferably 85–95%). The process uses an auxiliary low pressure column in addition to the conventional high pressure column and low pressure column. The auxiliary low pressure column, which is preferably operated at the same pressure as the main low pressure column and which is heat integrated with the top of the high pressure column by means of its bottom reboiler/condenser, pretreats the crude liquid oxygen from the bottom of the high pressure column. The resulting overhead vapor stream and bottom stream are subsequently fed to the main low pressure column. Preferably, the bottom stream is fed to the main low pressure column in a state which is at least partially vapor.

16 Claims, 2 Drawing Sheets

PROCESS TO PRODUCE MODERATE PURITY OXYGEN USING A DOUBLE COLUMN PLUS AN AUXILIARY LOW PRESSURE COLUMN

TECHNICAL FIELD OF THE INVENTION

The present invention relates to a process for the cryogenic distillation of an air feed. As used herein, the term "air feed" generally means atmospheric air but also includes any gas mixture containing at least oxygen and nitrogen.

BACKGROUND OF THE INVENTION

The target market of the present invention is moderate purity (80–99%, preferably 85–95%) oxygen such as the oxygen which is used in glass production. Although processes for the cryogenic distillation of an air feed which serve this market are taught in the art, increased competition from other technologies serving this market (most notably pressure swing adsorption technology) is forcing the cryogenic distillation technology to improve. Accordingly, it is an object of the present invention to improve the current cryogenic distillation technology. In particular, it is an object of the present invention to improve the energy efficiency, controllability, and layout flexibility of the current cryogenic distillation processes serving the oxygen market at issue.

The state of the art cycle built for the oxygen market at issue is the standard double-column cycle with liquid oxygen-boil (LOX-boil) which comprises a high pressure column thermally and physically linked to a low pressure column by a reboiler/condenser. Liquid oxygen product is withdrawn from the low pressure column, increased in pressure, and boiled to condense a portion of incoming air. If only a portion of the incoming air is totally condensed against the boiling oxygen product then the resultant liquid is often split into two fractions and used as intermediate reflux to both the high pressure and low pressure columns.

By way of example, and for discussions that follow, if the oxygen product pressure is to be approximately 25 psia, then the air pressure necessary for total condensation is approximately 80 psia. In the simplest configuration, all the air comes-in at a single pressure, about 80 psia. This air pressure is higher than that required to perform the separation. As a result one may, theoretically, elect to process air at two pressures: the portion of air which is to condense against boiling oxygen product enters at about 80 psia while the portion of air which is fed to the high pressure column enters at about 67 psia. This action reduces the specific power of oxygen production. The stream which is expanded (to provide cold-box refrigeration) may originate as either higher pressure or lower pressure air. The drawback of operating this cycle with dual-air pressures is that the compression ratios required to compress the air are unbalanced and lead to 1) more stages (higher cost) and/or 2) inefficient compression (higher power). For example, the first two stages of compression would have a pressure ratio of 2.1 (each stage) to bring the full flow to 67 psia, and a pressure ratio of 1.2 across the third stage to bring the high pressure air to 80 psia. In this example, the pressure ratio across the fist two stages is very large and might require adding an additional stage; the last stage, in contrast, has a very low ratio and would be difficult to design efficiently with commercially available compressor technology. If the incoming air stream is only partially condensed against the boiling oxygen product, then it is possible to reduce the incoming air pressure to as low as 73 psia. Unfortunately, this pressure is still higher than that required to perform the desired separation. Furthermore, the liquid which is produced is a poor intermediate reflux so the oxygen recovery of the process falls. The result is that the specific power of oxygen production is little better than if all the air were brought in at 80 psia and a fraction of the air totally condensed.

U.S. Pat. No. 4,702,757 by Kleinberg and assigned to Air Products and Chemicals, Inc. teaches the prototypical cycle for processing dual air pressure feeds. The important features of this dual reboiler cycle with LOX-boil/pumped LOX include (i) two reboilers in the low pressure column (the bottom reboiler is driven by partially condensing the lower pressure air feed; the upper reboiler is driven by condensing nitrogen vapor from the high pressure column); and (ii) two air feed pressures (the lower pressure feed is cooled and partially condensed in the bottom reboiler of the low pressure column; the higher pressure feed is cooled then split into two portions; one of these portions is expanded to the low pressure column to provide refrigeration; the other portion is condensed against the boiling liquid oxygen; the resultant liquid is split and used as intermediate reflux to both the high pressure and low pressure columns). For the production of moderate purity oxygen, Kleinberg's dual-reboiler, pumped-LOX cycle provides suitably low power to be competitive. However, this cycle has drawbacks due to high capital cost and concern over operability. Specifically, the upper reboiler is placed at an intermediate position within the low pressure column which is costly and inconvenient from a construction standpoint. Furthermore, this intermediate reboiler has strong process interactions with the bottom reboiler. Specifically, both reboilers have an influence on the air pressure. As a result, it is possible that the bottom reboiler, for example, takes too much duty and drives the air pressure to a higher level than design. The consequence is that the "real-world" specific power of oxygen production will invariably be slightly greater than the "theoretical".

U.S. Pat. No. 4,410,343 by Ziemer teaches a process which does not require the intermediate reboiler to provide the condensing duty for the high pressure column. Rather this exchanger is relocated to the top of the high pressure column where the nitrogen vapor is condensed against boiling crude liquid oxygen. The resultant crude gaseous oxygen is then sent to the low pressure column as a vapor feed (instead of crude liquid oxygen). The consequence of operating the high pressure column condenser with crude liquid oxygen is that the pressure of the air required to operate the low pressure column reboiler and the air pressure required for the high pressure column need not be the same. In fact, according to Ziemer, the optimal operation of this process would have the air feed pressure for the low pressure column reboiler (67 psia) higher than the air pressure for the high pressure column (45 psia). Ziemer's process relates to the production of low pressure gaseous oxygen directly from the low pressure column. If his teachings were extended to a LOX-boil/pumped-LOX cycle, there would be a third air pressure required (namely 80 psia for the condensation of air against boiling oxygen). The major disadvantage of Ziemer's process (extended to LOX-boil/pumped-LOX) is the complex and problematic front-end compression.

U.S. Pat. No. 5,337,570 by Prosser teaches a three feed air pressure cycle. The lowest pressure air feed is passed to the high pressure column, the intermediate pressure air feed is condensed in the low pressure column bottom reboiler, and the highest pressure feed is condensed against the boiling liquid oxygen product. Prosser's cycle also uses Ziemer's nitrogen condenser/crude liquid oxygen vaporizer in place of the upper reboiler of the Kleinberg-type cycle. As with the Ziemer cycle, theoretical power is competitive but front-end compression is complex.

European Patent Application 94301410 by Rathbone teaches a cycle similar to the teachings of Ziemer and Prosser but manages to make the process work with only two feed pressures instead of three. In Rathbone, a fraction of the lower pressure air feed is totally condensed in the bottom low pressure column reboiler while the other fraction is sent directly to the high pressure column. The higher pressure air feed is used to boil the oxygen product. Also in Rathbone, the crude liquid oxygen from the sump of the high pressure column is reduced in pressure and boiled to drive the condensation of nitrogen vapor for the high pressure column. Rathbone is able to lower the air pressure required to drive the low pressure column reboiler by withdrawing an intermediate liquid from the low pressure column (whose composition, if a vapor, would be in equilibrium with the liquid oxygen product), completely vaporizing it in (what is likely) a once through reboiler, and using that vapor to provide boilup to the low pressure column. Rathbone is able to take full thermodynamic advantage of dew point/bubble point temperature variations of this intermediate liquid and the low pressure air to match the temperature profiles and drive the air pressure to a lower level. Rathbone is, theoretically, well suited for low-to-moderate purity oxygen.

U.S. Pat. No. 5,231,837 by Ha teaches an air separation cycle wherein the top of the high pressure column is heat integrated with both the bottom of the low pressure column and the bottom of an intermediate pressure column. The intermediate column processes the crude liquid oxygen from the bottom of the high pressure column into a condensed top liquid fraction and a bottom liquid fraction which are subsequently fed to the low pressure column.

SUMMARY OF THE INVENTION

The present invention is a process for the cryogenic distillation of an air feed to produce an oxygen product, particularly an oxygen product at moderate purity (80–99%, preferably 85–95%). The process uses an auxiliary low pressure column in addition to the conventional high pressure column and low pressure column. The auxiliary low pressure column, which is preferably operated at the same pressure as the main low pressure column and which is heat integrated with the top of the high pressure column by means of its bottom reboiler/condenser, pretreats the crude liquid oxygen from the bottom of the high pressure column. The resulting overhead vapor stream and bottom stream are subsequently fed to the main low pressure column. Preferably, the bottom stream is fed to the main low pressure column in a state which is at least partially vapor.

DETAILED DESCRIPTION OF THE INVENTION

Figure 1:
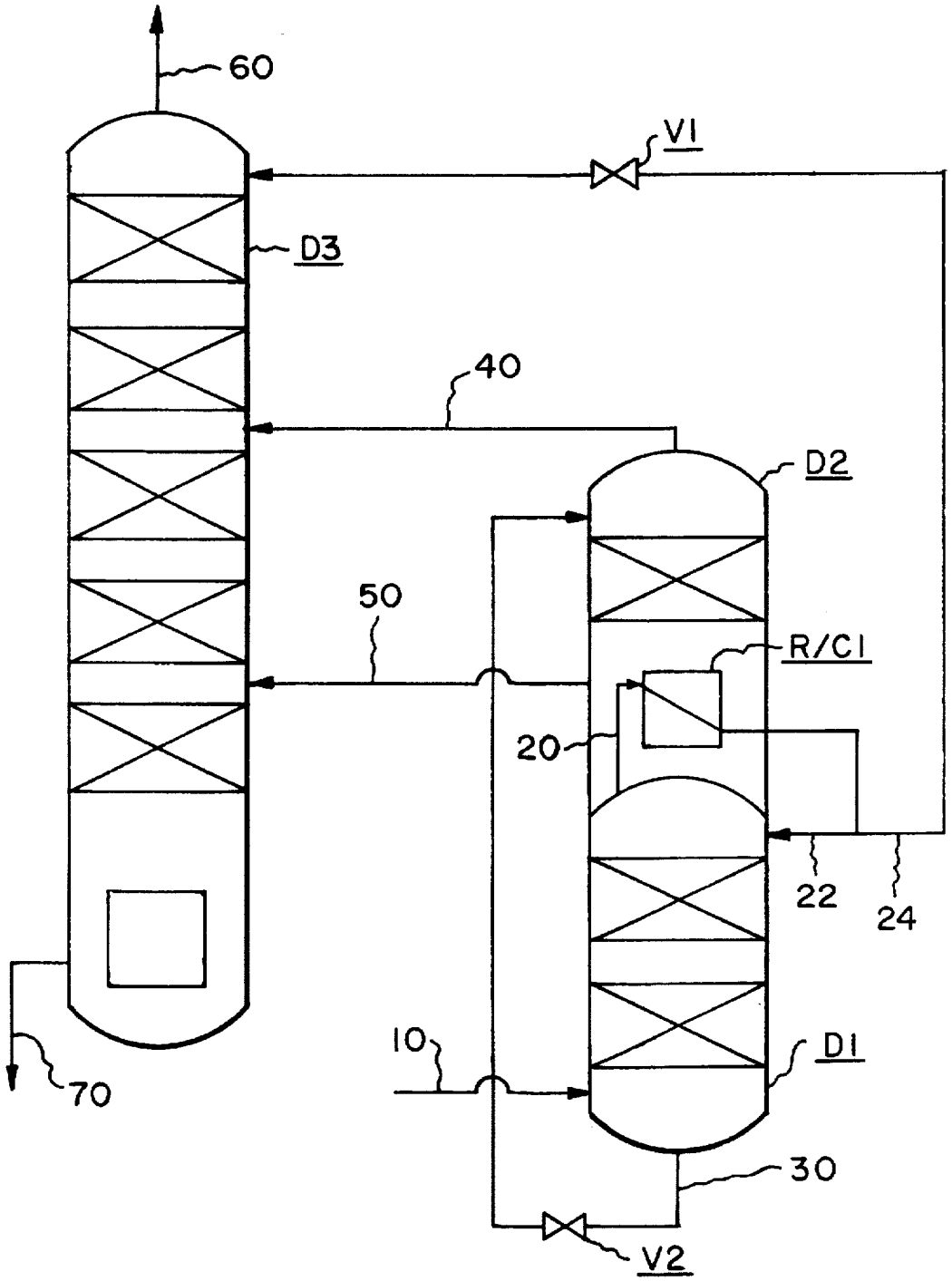
FIG. 1 is a schematic drawing of a general embodiment of the present invention.

The present invention is best illustrated with respect to a general embodiment thereof such as FIG. 1's embodiment. Referring now to FIG. 1, the present invention is a process for the cryogenic distillation of an air feed to produce an oxygen product [70] using a distillation column system comprising a high pressure column [D1], a main low pressure column [D3] and an auxiliary low pressure column [D2]. FIG. 1's process comprises:

(a) feeding at least a portion of the air feed [10] to the bottom of the high pressure column;

(b) removing a nitrogen-enriched overhead [20] from the top of the high pressure column, condensing at least a first portion of it in a first reboiler/condenser [R/C1] located in the bottom of the auxiliary low pressure column, splitting said condensed first portion into a first part [22] and a second part [24], feeding the first part as reflux to an upper location in the high pressure column, reducing the pressure of the second part across a first valve [V1] and feeding the second part as reflux to an upper location in the main low pressure column;

(c) removing a crude liquid oxygen stream [30] from the bottom of the high pressure column, reducing the pressure of at least a first portion of it across a second valve [V2] and feeding said portion as impure reflux to the top of the auxiliary low pressure column;

(d) removing a crude nitrogen overhead [40] from the top of the auxiliary low pressure column and feeding it directly as a vapor to an intermediate location in the main low pressure column;

(e) removing an oxygen-enriched stream [50] from a lower location in the auxiliary low pressure column as a vapor and/or liquid and feeding it to an intermediate location in the main low pressure column below the intermediate feed location of the crude nitrogen overhead in step (d);

(f) removing a nitrogen rich overhead [60] from the top of the main low pressure column; and (g) removing the oxygen product [70] from a lower location in the main low pressure column as a vapor and/or liquid.

An important feature of the present invention is the auxiliary low pressure column which will typically contain only three to six stages and which is heat integrated with the top of the high pressure column by means of its bottom reboiler/condenser. The auxiliary column allows better control of the process and more layout flexibility in terms of giving one the option to physically decouple the main low pressure column from the high pressure column. The auxiliary column can operate at any suitable pressure between the pressures of the high and main low pressure columns, although it has been unexpectedly found that the optimum pressure is the same pressure as the main low pressure column, plus the expected pressure drop between it and the main low pressure column.

The function of the auxiliary low pressure column is to convert the crude liquid oxygen [30] into two feeds [40 and 50] for the main low pressure column, thereby enhancing the operation of the main low pressure column and increasing oxygen recovery. The more important of these two feeds is the oxygen-enriched stream [50] which is preferably removed from the auxiliary low pressure column in a state which is at least partially vapor and subsequently fed to the main low pressure column. It is desirable that this stream be as oxygen rich as possible, subject to feasible operation of the reboiler/condenser [R/C 1] which links the high pressure column and the auxiliary low pressure column. In doing so, one is able to reduce the boilup required by the main low pressure column which translates into higher oxygen recovery. Likewise, if the main low pressure column bottom boilup can be reduced, then the air condensed in it is reduced and the vapor processed by the high pressure column can be increased and thus more nitrogen reflux can be produced. This second action also helps improve oxygen recovery by reducing losses in the main low pressure column overhead.

Figure 2:
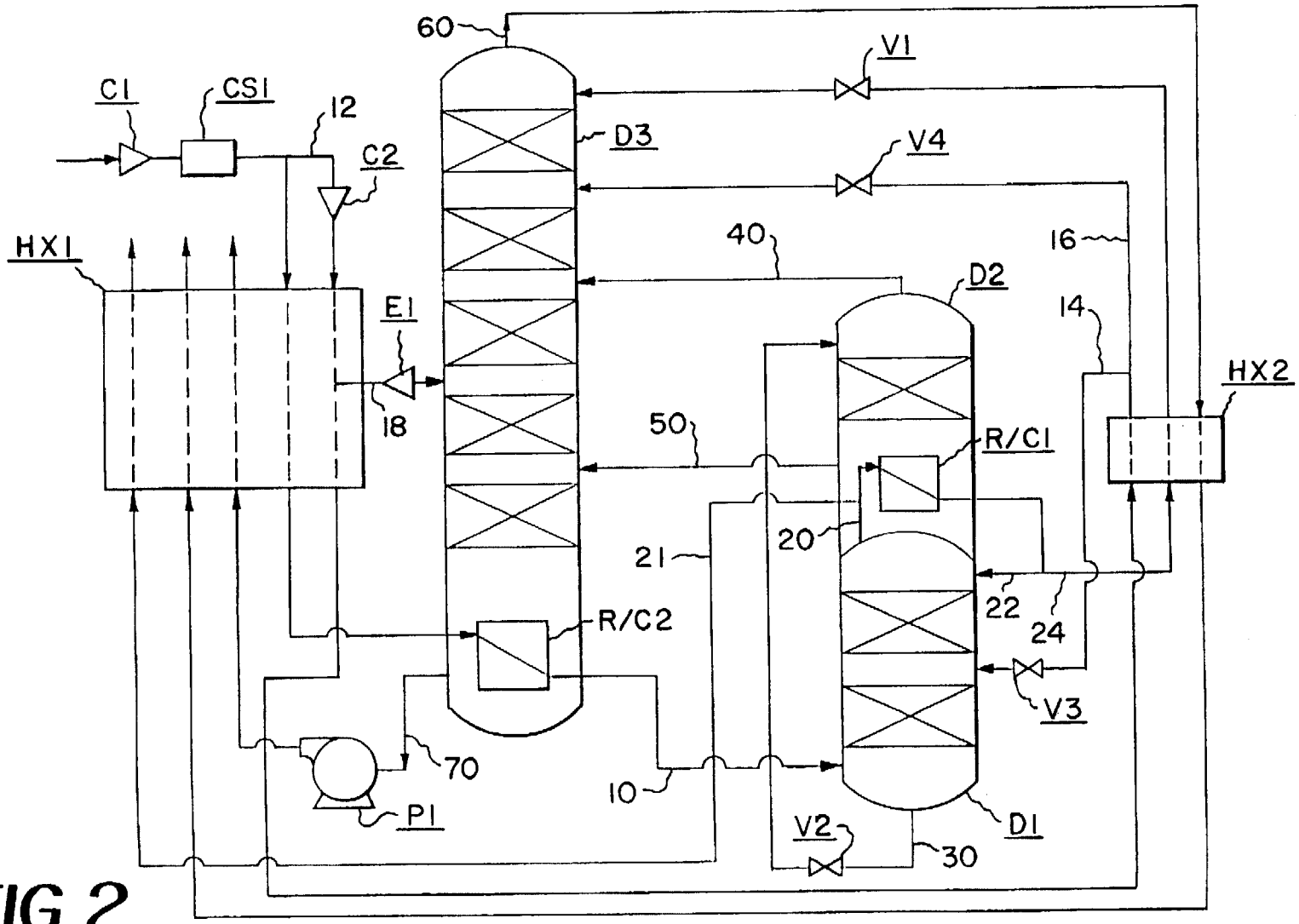
FIG. 2 is a schematic drawing of one embodiment of FIG. 1 wherein FIG. 1's general embodiment is integrated with a main heat exchanger, a subcooling heat exchanger and a refrigeration generating expander.

FIG. 2 is a schematic drawing of a second embodiment of the present invention wherein FIG. 1's general embodiment is integrated with other features of an air separation cycle including a main heat exchanger [HX1], a subcooling heat exchanger [HX2] and an expander [E1]. FIG. 2 is identical to FIG. 1 (common streams and equipment use the same identification), except for the following:

(1) The oxygen product [70] is removed as a liquid, pumped to an elevated pressure [in pump P1] and subsequently vaporized and warmed in the main heat exchanger.

(2) Prior to feeding at least a portion of the air feed [10] to the bottom of the high pressure column, the air feed is compressed [in a first compressor C1], cleaned of impurities which will freeze out at cryogenic temperatures [in a cleanup system CS1 which will typically comprise adsorbent beds], cooled in the main heat exchanger to a temperature near its dew point and partially condensed in a second reboiler/condenser [R/C2] located in the bottom of the main low pressure column.

(3) Prior to cooling the compressed and cleaned air feed in the main heat exchanger, the process further comprises removing an air reflux stream [12] from the air feed, further compressing the air reflux stream [in a second compressor C2], cooling and subsequently condensing the air reflux stream in the main heat exchanger, splitting the air reflux stream into a first portion [14] and a second portion [16], reducing the pressure of the first portion across a third valve [V3] and feeding it as reflux to the high pressure column and reducing the pressure of the second portion across a fourth valve [V4] and feeding it as reflux to an upper intermediate location in the main low pressure column.

(4) A refrigeration generating expander scheme whereby during the cooling of the air reflux stream [12] in the main heat exchanger, an air expansion stream [18] is removed, expanded in an expander [E1], and subsequently fed to an intermediate location in the main low pressure column which is between the intermediate feed locations of the crude nitrogen overhead [40] and the oxygen-enriched stream [50]. Optionally, this expanded stream could be combined with the air feed prior to either the air feed's partial condensation in reboiler/condenser R/C2 or prior to the air feed's introduction to the bottom of the high pressure column.

(5) The nitrogen rich overhead from the top of the main low pressure column [60], also referred to as the waste nitrogen, is warmed in the main heat exchanger. A portion of the warmed waste nitrogen can be used to regenerate the adsorbent beds contained in the front end cleanup system [CS1].

(6) Prior to warming the waste nitrogen [60] in the main heat exchanger, the waste nitrogen is warmed in a subcooling heat exchanger [HX2] against:

(i) the second part [24] of the condensed nitrogen-enriched overhead from the high pressure column in step (b) prior to it being reduced in pressure fed as reflux to an upper location in the main low pressure column; and (ii) the condensed air reflux stream prior to splitting said stream into portions 14 and 16 and feeding them as reflux to, respectively, the high and main low pressure columns. Optionally, this heat exchange could be performed after portions 14 and 16 are split, thereby allowing portions 14 and 16 to be subcooled to different extents in the subcooling heat exchanger.

(7) A second portion [21] of the nitrogen-enriched overhead from the top of the high pressure column is warmed in the main heat exchanger and removed as a product stream.

Note in FIG. 2 that the entire amount of the nitrogen-enriched overhead [20] which is removed from the top of the high pressure column is condensed against vaporizing oxygen-enriched liquid from the bottom of the auxiliary low pressure column, except for a second portion [21] which may optionally be removed as a product stream as noted in (7) above. This is unlike U.S. Pat. No. 5,231,837 by Ha discussed earlier where a portion of the overhead from the top of the high pressure column is also condensed in the bottom of the main low pressure column. (In Ha, the top of the high pressure column is heat integrated with both the bottom of Ha's intermediate pressure column and the bottom of Ha's low pressure column.) As a consequence, FIG. 2 allows the feed air pressure to be lower and in this case leads to energy savings.

Computer simulations of FIG. 2's embodiment have demonstrated that the present invention is particularly suitable for the production of the oxygen product at moderate purity (85–95%) and moderate pressure (25–30 psia). Table 1 below summarizes one such simulation on the basis of a 100 mole material balance. Note that the oxygen product [70] which is produced at the bottom of the main low pressure column at 19.5 psia would be pumped to the appropriate moderate pressure in pump P1, taking into account the expected pressure drop across the main heat exchanger.

TABLE 1

| Stream | Pressure | Flow | Composition (mole %) | | |
|---|---|---|---|---|---|
| No. | (psia) | (mole/100) | N2 | Ar | O2 |
| 10 | 48.1 | 48.7 | 78.12 | 0.93 | 20.95 |
| 12 | 51.0 | 51.3 | 78.12 | 0.93 | 20.95 |
| 18 | 78.5 | 22.7 | 78.12 | 0.93 | 20.95 |
| 24 | 47.5 | 24.0 | 96.93 | 0.35 | 2.72 |
| 30 | 48.1 | 33.7 | 64.73 | 1.34 | 33.93 |
| 40 | 20.0 | 11.7 | 85.32 | 0.81 | 13.87 |
| 50 | 20.0 | 22.0 | 53.72 | 1.63 | 44.65 |
| 70 | 19.5 | 21.6 | 6.59 | 3.00 | 90.41 |
| 60 | 18.3 | 78.4 | 97.83 | 0.36 | 1.81 |
| 21 | | 0.0 | | | |

The skilled practitioner will appreciate that there are many modifications and/or variations to FIG. 2's embodiment which are possible. For example:

(1) With regard to the refrigeration generating expander scheme, many alternatives are possible. For example, the air to be expanded could originate from air feed 10 at a point where this stream is being cooled in the main heat exchanger. Or the air to be expanded could be brought in as a "third air" circuit utilizing an air compander whereby the air to be expanded is removed from air feed 10 just after air feed 10 is compressed and cleaned. After removal, the air to be expanded is further compressed in a compressor, cooled in the main heat exchanger and expanded in an expander wherein said expander and said compressor are linked as a compander. Or refrigeration for the process can be provided by an expander scheme whereby at least a portion of the nitrogen-enriched overhead [21] from the top of the high pressure column is warmed in the main heat exchanger, expanded in an expander and re-warmed in the main heat exchanger.

(2) Prior to reducing the pressure of the crude liquid oxygen [30] across valve V2 and feeding it to the auxiliary low pressure column, this stream could be subcooled in the subcooling heat exchanger [HX2].

(3) If appropriate, a portion of the crude liquid oxygen [30] could be reduced in pressure and fed directly to the main low pressure column. This might be beneficial where one elects to remove the oxygen product stream [70] in a state which is at least partially vapor.

(4) In the interest of gaining thermodynamic efficiency, one could conceivably replace one or more of valves V1, V2, V3 and V4 with expanders, thereby performing the pressure reductions largely at constant entropy instead of at constant enthalpy. Such efficiency gain, however, would come at the expense of increased capital and operating complexity.

(5) Rather than passing all of air feed [10] to reboiler/condenser R/C2 as shown in FIG. 2, only a portion of it could be heat exchanged and totally condensed. The remaining portion of the air which bypasses R/C2 could be sent directly to the bottom of the high pressure column.

(6) After compression, air reflux stream [12] could be cooled and condensed in an alternate heat exchanger (not in the main heat exchanger HX1) by heat exchange against the oxygen product stream [70] from pump P1. In this case it may also be advantageous to warm a portion of the waste nitrogen stream [60] in the alternate heat exchanger as well.

(7) In FIG. 2, the condensed air reflux stream is split between the main low pressure column and the high pressure column (streams 14 and 16). Alternatively, all of the condensed air stream could be fed to only one of the two distillation columns.

(8) Even though the target range of oxygen product pressure is 25–30 psia, it is understood that there is no limitation on oxygen product pressure. The selection of oxygen product pressure determines the pressure of the air reflux stream [12] after its compression. If the oxygen pressure is desired at very low pressure (less than or equal to the main low pressure column pressure, typically 20 psia) it is also possible to draw the oxygen product [70] from the main low pressure column as a vapor.

(9) In both Figures, it is shown that the condensed nitrogen enriched overhead from the first reboiler/condenser R/C1 is split in two streams (22 and 24). Alternatively all of the condensed nitrogen enriched overhead can be used to reflux the high pressure column D1. In this event, if a reflux for the main low pressure column is desired, one could withdraw a liquid from the high pressure column a few stages below the top of the column. This is particularly useful when a portion of the nitrogen enriched overhead [21] is desired as a high purity product.

(10) It is understood that the waste stream [60] could be a useful product in its own right.

The skilled practitioner will further appreciate that there are many other embodiments of the present invention which are within the scope of the following claims.

We claim:

1. A process for the cryogenic distillation of an air feed to produce an oxygen product using a distillation column system comprising a high pressure column, a main low pressure column and an auxiliary low pressure column, said process comprising:

(a) feeding at least a portion of the air feed to the bottom of the high pressure column;

(b) removing a nitrogen-enriched overhead from the top of the high pressure column, condensing at least a first portion of it in a first reboiler/condenser located in the bottom of the auxiliary low pressure column and feeding at least a first part of the condensed first portion as reflux to an upper location in the high pressure column;

(c) removing a crude liquid oxygen stream from the bottom of the high pressure column, reducing the pressure of at least a first portion of it and feeding said portion as impure reflux to the top of the auxiliary low pressure column;

(d) removing a crude nitrogen overhead from the top of the auxiliary low pressure column and feeding it directly as a vapor to an intermediate location in the main low pressure column;

(e) removing an oxygen-enriched stream from a lower location in the auxiliary low pressure column as a vapor and/or liquid and feeding it to an intermediate location in the main low pressure column below the intermediate feed location of the crude nitrogen overhead in step (d);

(f) removing a nitrogen rich overhead from the top of the main low pressure column as waste nitrogen; and (g) removing the oxygen product from a lower location in the main low pressure column as a vapor and/or liquid.

2. The process of claim 1 wherein the entire amount of the nitrogen-enriched overhead which is removed from the top of the high pressure column is condensed against vaporizing oxygen-enriched liquid from the bottom of the auxiliary low pressure column, except for a second portion which may optionally be removed as a product stream.

3. The process of claim 1 wherein the oxygen-enriched stream which is removed from the auxiliary low pressure column in step (e) is removed in a state which is at least partially vapor.

4. The process of claim 1 wherein the auxiliary low pressure column is operated at the same pressure as the main low pressure column, plus the expected pressure drop between the auxiliary low pressure column and the main low pressure column.

5. The process of claim 1 wherein the oxygen product is produced at moderate purity (85–95%).

6. The process of claim 1 wherein the oxygen product which is removed from the bottom of the main low pressure column in step (g) is removed as a liquid and is subsequently vaporized and warmed in a heat exchanger.

7. The process of claim 6 wherein the oxygen product is pumped to an elevated pressure prior to vaporization.

8. The process of claim 1 wherein a second part of the condensed nitrogen-enriched overhead from the top of the high pressure column in step (b) is reduced in pressure and fed as reflux to an upper location in the main low pressure column.

9. The process of claim 1 wherein prior to feeding the air feed to the bottom of the high pressure column in step (a), at least a portion of the air feed is at least partially condensed in a second reboiler/condenser located in the bottom of the main low pressure column.

10. The process of claim 9 wherein prior to partially condensing the air feed in the second reboiler/condenser, the air feed is compressed, cleaned of impurities which will freeze out at cryogenic temperatures and cooled in a main heat exchanger to a temperature near its dew point.

11. The process of claim 10 wherein prior to cooling the compressed and cleaned air feed in the main heat exchanger, the process further comprises removing an air reflux stream from the air feed, further compressing the air reflux stream, cooling and subsequently condensing the air reflux stream in an external heat exchanger, splitting the air reflux stream into a first portion and a second portion, reducing the pressure of the first portion across a third valve and feeding it as reflux to the high pressure column and reducing the pressure of the second portion across a fourth valve and feeding it as reflux to an upper intermediate location in the main low pressure column.

12. The process of claim 11 where the external heat exchanger is the main heat exchanger.

13. The process of claim 12 wherein during the cooling of the air reflux stream in the main heat exchanger, an air expansion stream is removed and expanded in an expander to produce an expanded air stream.

14. The process of claim 13 wherein the expanded air stream is fed to an intermediate location in the main low pressure column which is between the intermediate feed locations of the crude nitrogen overhead in step (d) and the oxygen-enriched stream in step (e).

15. The process of claim 14 wherein the waste nitrogen removed in step (f) is warmed in the main heat exchanger.

16. The process of claim 15 wherein prior to warming the waste nitrogen in the main heat exchanger, said waste nitrogen is warmed in a subcooling heat exchanger against:

(i) the second part of the condensed nitrogen-enriched overhead from the high pressure column in step (b) prior to it being reduced in pressure fed as reflux to an upper location in the main low pressure column; and (ii) the condensed air reflux stream prior to splitting said stream into said first portion and said second portion and feeding said portions as reflux to, respectively, the high and main low pressure columns.

* * * * *